US005425400A

United States Patent [19]

Szatmary

[11] Patent Number: 5,425,400

[45] Date of Patent: Jun. 20, 1995

[54] TRANSFER PORT APPARATUS AND METHOD

[75] Inventor: Michael A. Szatmary, Indianapolis, Ind.

[73] Assignee: Lee A. Francis, Littleton, Colo. ; a part interest

[21] Appl. No.: 38,173

[22] Filed: Mar. 29, 1993

[51] Int. Cl.[6] ..... B65B 1/04; B65B 3/04

[52] U.S. Cl. ..... 141/98; 141/346; 206/334

[58] Field of Search ..... 141/98, 346, 348, 383, 141/384, 386; 414/217, 222, 292; 285/196, 901; 220/326, 3.8, 242, 254; 138/92; 600/21, 22; 206/334, 328, 454

[56] References Cited

U.S. PATENT DOCUMENTS

| | | | |
|---|---|---|---|
| 3,406,988 | 6/1966 | Jones | 285/196 |
| 3,682,208 | 8/1972 | Fedi et al. | 141/384 |
| 4,209,013 | 6/1980 | Alexander et al. | 128/213 A |
| 4,369,779 | 1/1983 | Spencer | 128/213 A |
| 4,412,835 | 11/1983 | Spencer | 604/29 |
| 4,443,215 | 4/1984 | Smith | 604/29 |
| 4,494,586 | 1/1985 | Picard | 141/384 |
| 4,507,119 | 3/1985 | Spencer | 604/280 |
| 4,516,971 | 5/1985 | Spencer | 604/280 |
| 4,610,670 | 9/1986 | Spencer | 604/29 |
| 4,616,683 | 10/1986 | Tullis et al. | 141/383 |
| 4,619,642 | 10/1986 | Spencer | 604/29 |
| 5,139,459 | 8/1992 | Takahashi et al. | 454/187 |
| 5,226,781 | 7/1993 | Glachet et al. | 414/292 |
| 5,291,925 | 3/1994 | Marrucchi | 141/98 |

FOREIGN PATENT DOCUMENTS 0095971 12/1983 European Pat. Off. .

*Primary Examiner*—Henry J. Recla
*Assistant Examiner*—Steven O. Douglas
*Attorney, Agent, or Firm*—Barnes & Thornburg

[57] ABSTRACT

A transfer port apparatus is provided for transferring an item through a port formed in a wall of a housing and into an interior region of the housing. The apparatus includes a door collar assembly formed to include an aperture therethrough, an arcuate groove surrounding the aperture, and threads for coupling the door collar assembly to the wall of the housing so that the aperture is in communication with the port to permit insertion of the item into the interior region of the isolation chamber. The apparatus also includes a door gasket located in the arcuate groove of the door assembly, and a door configured to be inserted into the aperture of the door collar assembly. The door has an outer peripheral surface aligned with the door gasket. The apparatus further includes a mechanism for biasing the door gasket against the outer peripheral surface of the door to retain the door in the door collar assembly and to seal the door in the door collar assembly.

18 Claims, 6 Drawing Sheets

TRANSFER PORT APPARATUS AND METHOD

BACKGROUND AND SUMMARY OF THE INVENTION

The present invention relates to a transfer port apparatus and method for transferring the contents of a container into an isolation chamber. More particularly, the present invention provides an improved transfer port design which reduces the likelihood of transferring contaminants into the isolation chamber.

It is known to provide isolation chambers or "clean rooms" to provide an aseptic or sterile environment for various purposes. In clean rooms, elaborate precautions are taken to reduce dust particles and other contaminants in the air. The pharmaceutical industry uses the sterile environment provided by the isolating chambers for conducting experiments and tests and for manufacturing drugs. The electronics industry uses clean rooms to manufacture various types of electrical components. Because the clean rooms must be kept aseptic or sterile in order for the experiments and the testing or manufacturing procedures to be effective, it is desirable to reduce the likelihood that contaminants will be transferred into the isolation chamber. Therefore, problems arise when items must be transferred from a non-sterile environment outside the isolation chamber into the isolation chamber.

An object of the present invention is to provide a transfer port apparatus which includes an improved sealing and retaining mechanism to reduce the likelihood that contaminants will be transferred into the isolation chamber when items are delivered through the transfer port.

Isolation chambers are also used to test hazardous chemicals or nuclear devices. When used with potent materials, it is important to prevent the potent materials inside the isolation chamber from escaping to the environment surrounding the isolation chamber. Therefore, it is desirable to provide a transfer port apparatus for transferring items into the potent isolation chamber without releasing the potent contents of the isolation chamber to the outside environment.

In the transfer port apparatus of the present invention, a door is removably sealed to a port formed in a wall of the housing defining the isolation chamber. Specifically, a door collar assembly is coupled to the port formed in the wall of the housing. A spring band and door gasket are located within a groove formed in the door collar assembly. The door gasket is configured to engage a generally concave outer peripheral surface of the removable door to seal the door and also to provide means for retaining the door in the door collar assembly. In other words, the door gasket and spring band advantageously provide two separate functions. The first function is to seal the door inside the door collar assembly to prevent transfer of air or other contaminants through the wall of the isolation chamber. The door gasket and spring band also retain the door inside the collar assembly. Another latching mechanism is required to retain the door in the collar assembly. Therefore, the door assembly of the present invention provides simple, flat surfaces and very few parts. By minimizing the number of parts required to seal and retain the door in the door collar assembly, the transfer port apparatus of the present invention facilitates cleaning of the components of the door assembly and reduces the likelihood of transferring contaminants into the isolation chamber.

The present invention is designed to transfer sterile contents within a container assembly into the isolation chamber without transferring contaminants into the isolation chamber. The container assembly is formed to include a container body and a container collar assembly coupled to the container body. The collar assembly is formed to include a groove therein which is configured to receive a lid gasket and a spring band therein. A lid for the container is configured to be inserted into the container collar assembly to close the container assembly. The lid has a generally concave outer peripheral surface aligned longitudinally with the lid gasket in the collar assembly. The spring band applies a radially inwardly directed force on the lid gasket to force the container gasket against the concave outer peripheral surface of the lid. Therefore, the lid gasket assembly inside the container collar assembly advantageously performs two separate functions. The first function is to seal the lid to the container to prevent contaminants from entering the interior region of the container. The second function performed by the lid gasket assembly is to secure and lock the lid in place within the containers collar assembly. No other latching mechanism is required to secure the lid to the container assembly. As discussed above with reference to the door assembly, minimizing the number of parts required to seal and retain the lid in the container collar assembly advantageously facilitates cleaning of the components of the container assembly and reduces the likelihood of transferring contaminants into the isolation chamber.

In operation, the door is locked in place by the door gasket and spring band in the door collar assembly to prevent passage of air or contaminants through the port formed in the wall of the isolation chamber. A sterile item to be inserted into the isolation chamber is loaded into the sterile interior region of the container assembly and the lid is locked in place by the lid gasket and spring band. The lid gasket prevents air or other contaminants from entering the interior region of the container assembly. However, contaminants may be present on the outer surface of the container assembly and on the outer surface of the lid which is exposed to the environment outside the isolation chamber. The container assembly is then positioned adjacent the door assembly. The outer surface of the lid and the outer surface of the door are configured to be coupled together. Illustratively, the outer surface of the door includes an outwardly extending lip portion configured to mate with a recessed lip portion in the top surface of the door to secure the lid to the door. Other coupling techniques can be used to secure the door to the lid as discussed below. Coupling the door and lid together advantageously traps any contaminants which may be present on the outer surface of the door against the exposed outer surface of the lid. The door collar assembly and the container collar assembly are then coupled together to prevent relative movement of the door assembly and the container assembly.

After the container collar assembly and the door collar assembly are locked in place, the spring band inside the container collar assembly is flexed radially outwardly to permit the lid gasket to move away from the concave outer peripheral surface of the lid. The lid can then be removed from the container assembly. In addition, the spring band inside the door collar assembly is also be flexed radially outwardly to permit the door gasket to move away from the concave outer peripheral surface of the door. Therefore, the door can be removed from the door collar assembly.

The spring bands may be flexed manually using plungers which engage a portion of the spring bands to enlarge the circumference of the spring bands. In addition, a vacuum source or a pressure source may be coupled to the container collar assembly and the door collar assembly for flexing the gasket. In the embodiments using the vacuum source or pressure source, it is not necessary to use spring bands to flex the gaskets. Typically, a pressure source is used to flex the gaskets when the isolation chamber is aseptic or sterile. A vacuum source is typically used when the interior region of the isolation chamber is potent or hazardous.

The door gasket and the container lid gasket must have good resiliency characteristics in order to move radially inwardly to seal the door or lid and to retain the door or lid in its respective collar assembly when the gaskets are biased radially inwardly by the spring bands, the pressure source, or the vacuum source. In addition, the gaskets must have a good memory characteristic so that when the biasing means releases the gaskets, the gaskets move away from the peripheral surfaces of the door and lid to assume their original non-biased memory shapes, thereby permitting the door to be removed from the door collar assembly and the lid to be removed from the container collar assembly.

After the biasing means permits the door gasket and lid gasket to move away from the peripheral surfaces of the door and lid, respectively, an operator removes the door and the lid coupled to the door as a unit from the interior region of the isolation chamber. The operator can reach through the wall of the isolation chamber using conventional gloves to remove the door and lid unit when the size of the door and lid unit permits such removal. If the size of the door and lid unit is too large for manual removal, a mechanism inside the interior region of the isolation chamber is controlled by the operator to remove the door and lid unit. The contents of the container assembly are then accessible from the interior region of the isolation chamber. The only surfaces exposed to the interior region of the isolation chamber are the sterile inner surface of the container assembly and the sterile inner surface of the lid. Therefore, contaminants are not introduced into the interior region of the isolation chamber.

After the Contents of the container are removed, the door and lid unit is reinserted through the port so that the door and lid are aligned longitudinally with the door gasket and lid gasket, respectively. The biasing means is then activated to move the door gasket and lid gasket radially inwardly against the peripheral surfaces of the door and lid, respectively. This inward movement of the gaskets seals the door and lid to the door collar assembly and lid collar assembly. In addition, the door gasket and lid gasket retain the door and lid within the door collar assembly and lid collar assembly. It is not required to use any other type of retention mechanism to secure the door and lid to the door collar assembly and lid collar assembly. After the door and lid are sealed and locked, the container assembly is removed from the door assembly.

The apparatus and method of the present invention provides a minimum number of parts for sealing and locking the lid and door in place. The parts have relatively flat surfaces to facilitate cleaning of the parts, thereby reducing the likelihood of transferring contaminants into the isolation chamber.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
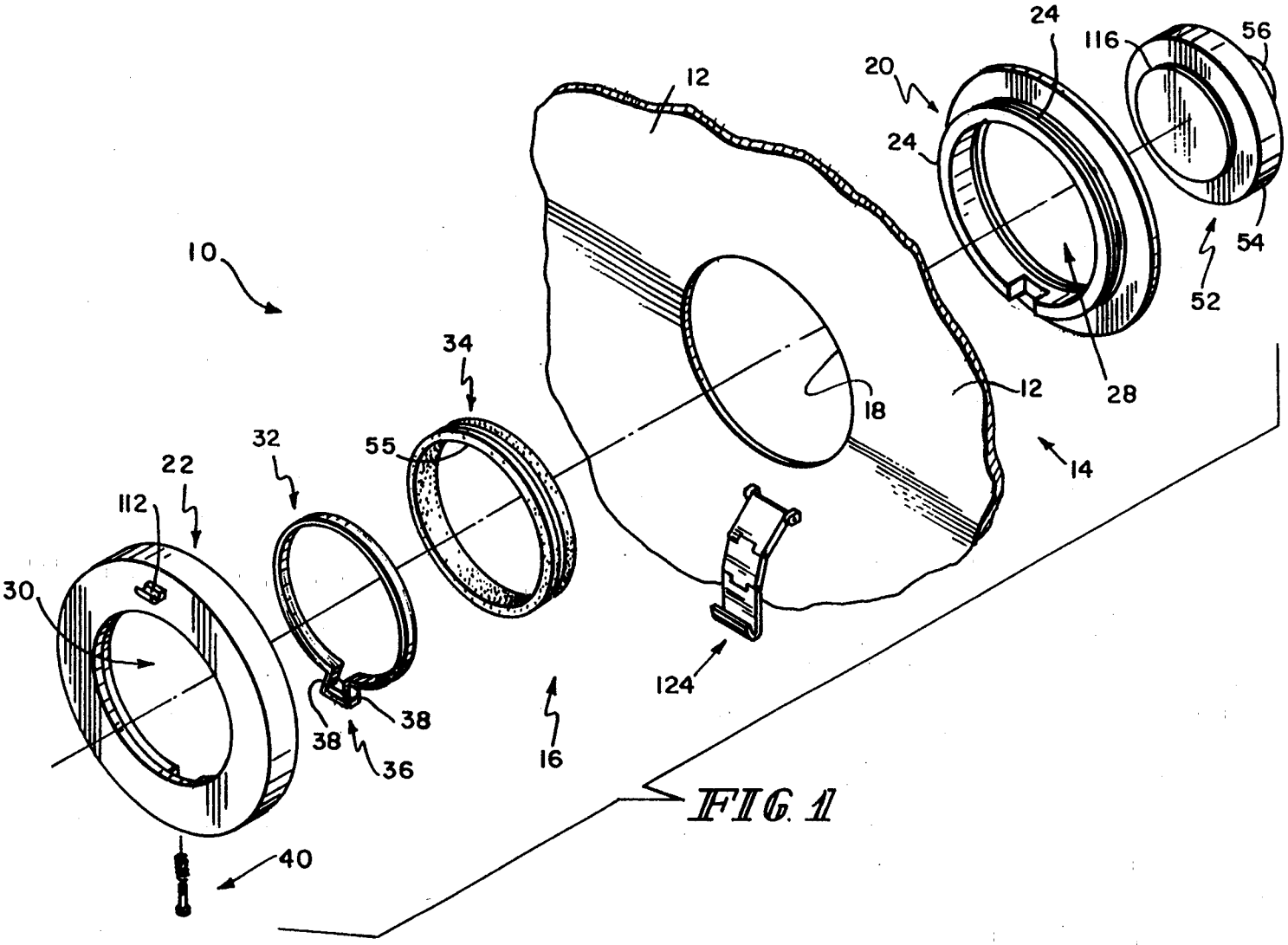
FIG. 1 is an exploded perspective view of a door assembly of the present invention for providing a door through a port formed in a wall of an isolation chamber, the door assembly including a door collar assembly, a spring band, a door gasket, and a door.
Figure 6:
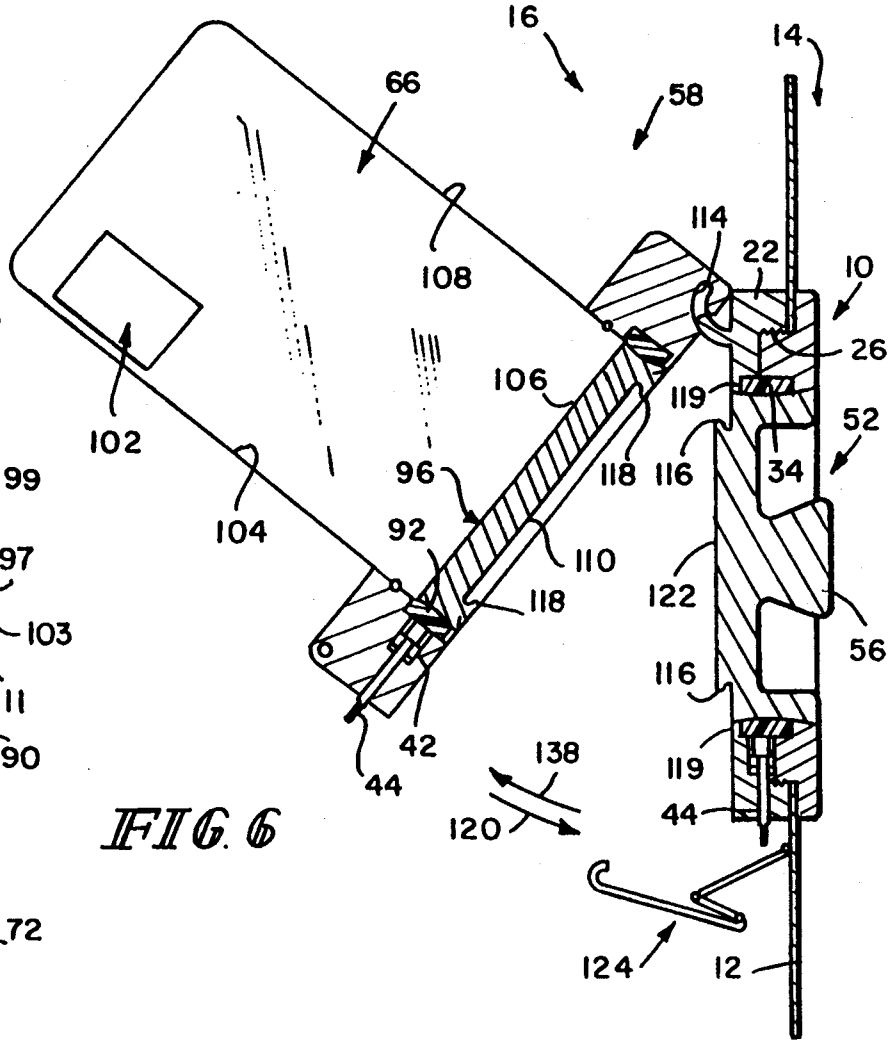
FIG. 6 is a sectional view taken through the transfer port assembly of the present invention illustrating the container assembly being installed onto the door assembly.
Figure 8:
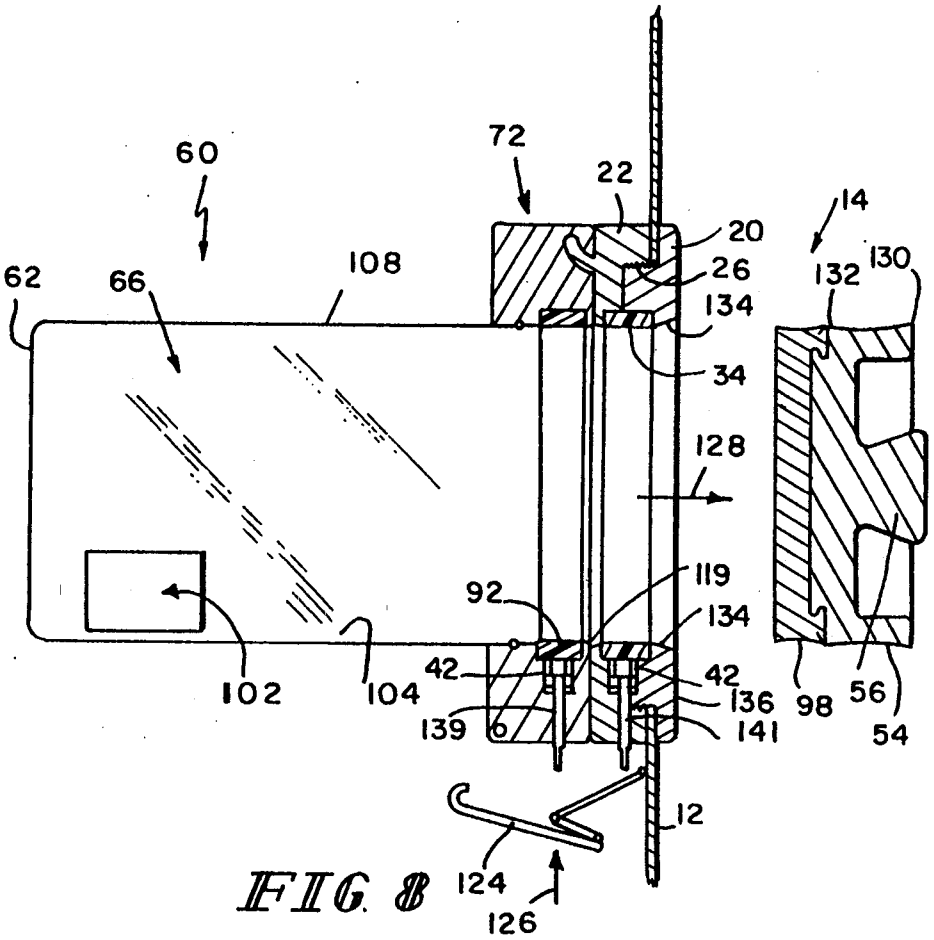
FIG. 8 is a sectional view similar to FIGS. 6 and 7 illustrating the spring bands in their flexed positions to disengage the door gasket and the lid gasket from the door and lid, respectively, to permit the locked door and lid to be removed from the door collar assembly and lid collar assembly as a single unit, thereby providing communication between the interior region of the isolation chamber and an interior region of the container.
Figure 7:
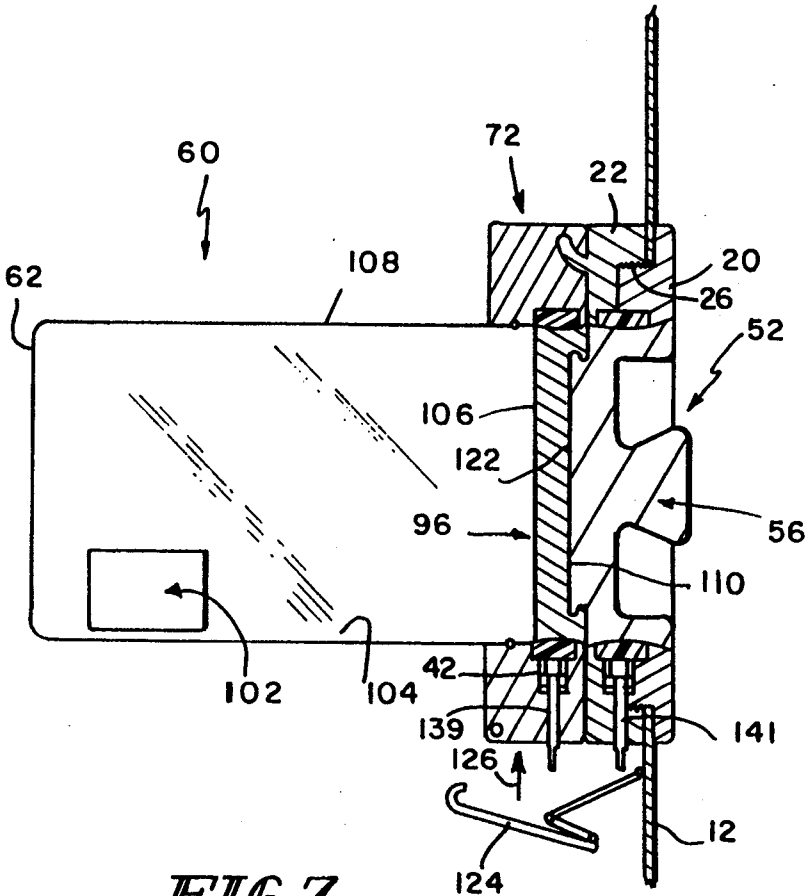
FIG. 7 is a sectional view similar to FIG. 6 illustrating the lid of the container assembly locked onto the door of the door assembly prior to locking the container assembly to the door assembly and releasing the tension of the spring bands in the container assembly and door assembly.

Referring now to the drawings, FIG. 1 illustrates a door assembly 10 of the present invention. Door assembly 10 is configured to be coupled to a wall 12 of an isolation chamber or clean room. It is often desirable to insert items into the interior region 14 of the isolation chamber from a region 16 outside the isolation chamber. Therefore, an opening or port 18 is formed in wall 12 of the chamber. Door assembly 10 includes a door collar assembly having a first collar portion 20 located in interior region 14 of the isolation chamber and a second collar portion 22 located outside the isolation chamber. Collar portions 20 and 22 include threaded sections 24 and 26, respectively, configured to engage each other to secure collar portion 20 to collar portion 22. As best illustrated in FIGS. 6–8, when collar portion 20 and collar portion 22 are threaded together, a portion Of wall 12 is trapped between collar portion 20 and collar portion 22. Collar portions 20 and 22 are formed to include central apertures 28 and 30, respectively, therein. Apertures 28 and 30 are in communication with port 18 in wall 12 to permit items to be inserted through port 18.

Door assembly 10 further includes a spring band 32 and a door gasket 34 configured to be inserted into an arcuate groove formed in the door collar assembly after collar portions 20 and 22 are coupled together. Spring band 32 is located radially outwardly from gasket 34. Spring band 32 is configured to apply a radially inwardly directed force on gasket 34 when spring band 32 is in its normal, relaxed position.

Figure 3:
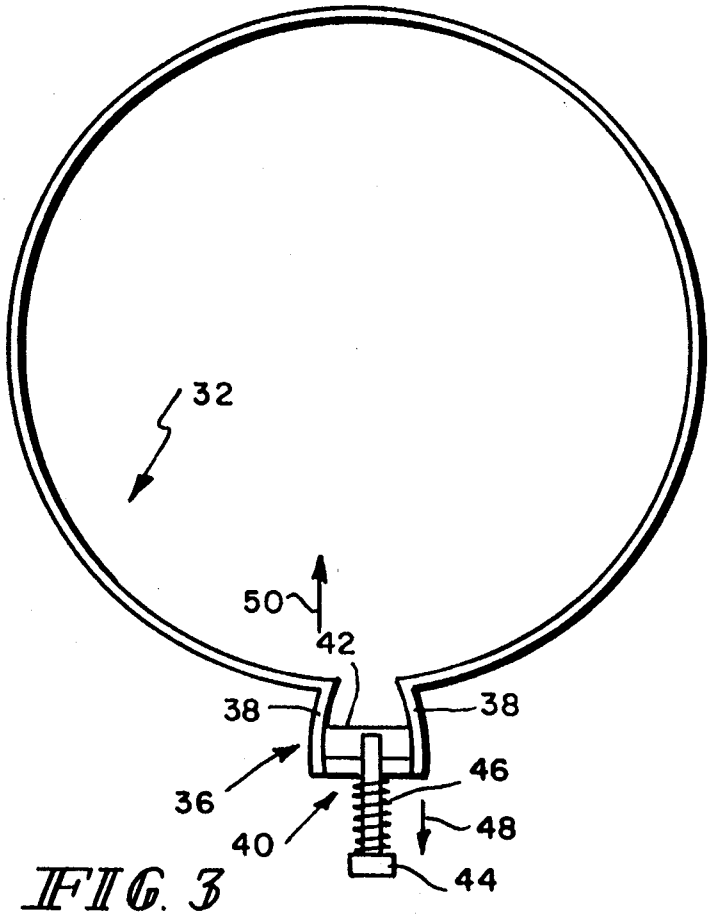
FIG. 3 is an elevational view illustrating the configuration of the spring bands of the present invention.

Spring band 32 is formed to include a ramped control section 36 having opposite side members 38 which form ramped surfaces. Spring band 32 is best illustrated in FIG. 3. An actuator or plunger 40 includes a head portion 42 and a stem 44. A spring surrounds stem 44 to apply a biasing force on plunger 40 in a direction of arrow 48 to hold plunger 40 in the position illustrated in FIG. 3. Therefore, spring band 32 remains in its normal, relaxed position. When plunger 40 is forced in the direction of arrow 50, head 42 of plunger 40 engages ramped surfaces 38 of control section 36 to force spring band 32 to its expanded or flexed position. Movement of spring band 32 to its flexed position removes the radially inwardly directed force from gasket 34. Therefore, gasket 34 assumes its non-biased memory configuration as discussed in detail below.

Referring again to FIG. 1, door assembly 10 also includes a door 52 having a generally concave outer peripheral surface 54. An inner surface 55 of gasket 34 is configured to engage the outer surface 54 of door 52 to seal and to retain door 52 within door collar assembly 20 and 22. This seal prevents air and contaminants from passing through port 18 and into or out of the isolation chamber. Door 52 also includes a handle 56 to permit removal of the door after the container assembly 58 is installed onto door assembly 10 as discussed in detail below.

Figure 2:
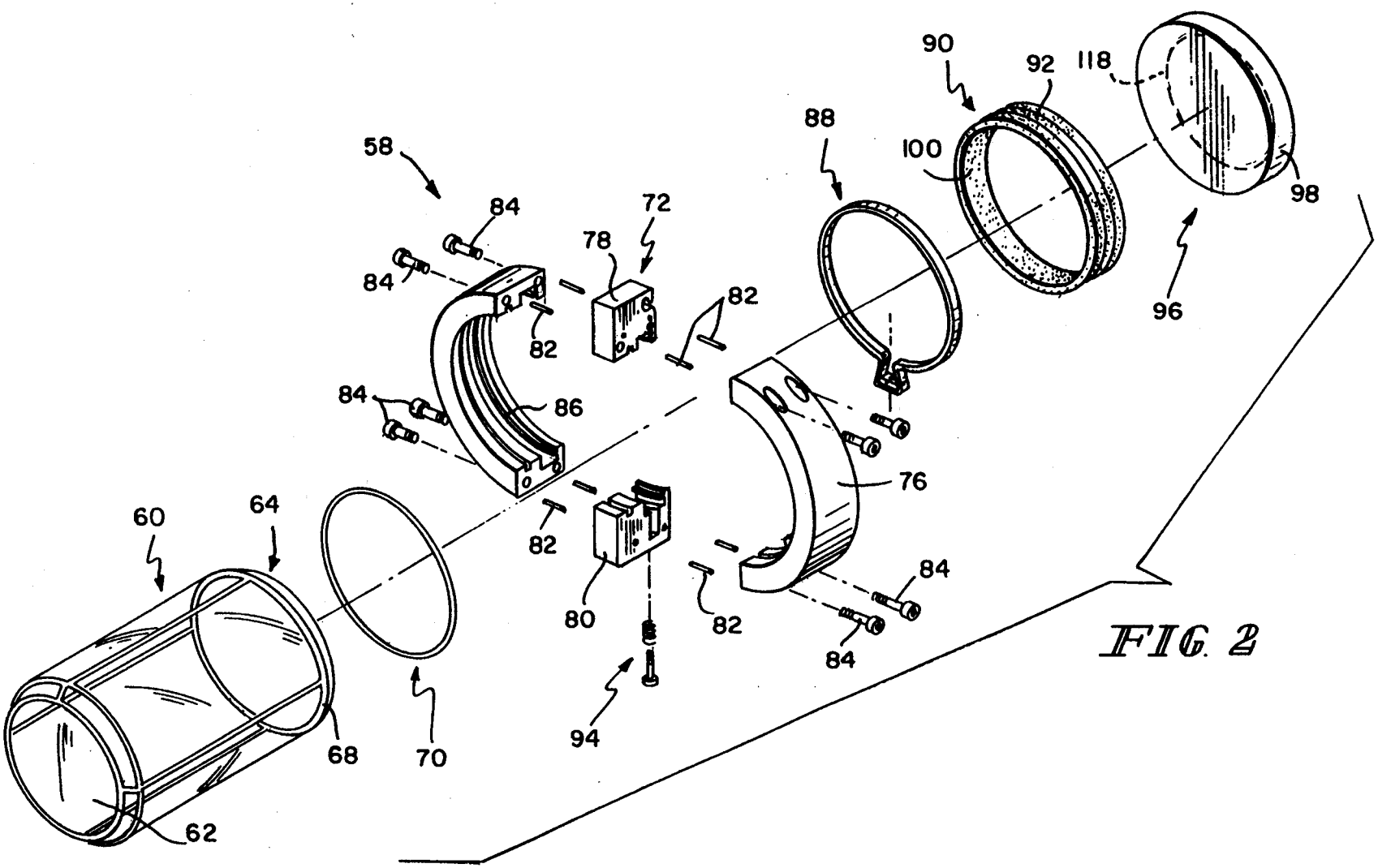
FIG. 2 is an exploded perspective view illustrating a container assembly of the present invention including a container, an O-ring seal, a container collar assembly, a spring band, a container gasket, and a container lid.

Referring now to FIG. 2, container assembly 58 includes a container 60 having a closed end 62 and an open end 64 to permit items to be inserted into an interior region 66 of container 60. Container 60 is formed to include a circumferentially extending groove 68 for receiving an O-ring 70 therein. Container assembly 58 also includes a collar assembly 72. Collar assembly 72 includes symmetrical body portions 74 and 76 and connector block portions 78 and 80. Body portions 74 and 76 and connector blocks 78 and 80 are coupled together using alignment pins 82 and suitable fasteners 84. Each of the body portions 74 and 76 and connector blocks 78 and 80 are formed to include radially inwardly opening groove therein. When body portions 174 and 76 and connector blocks 78 and 80 are coupled together, the grooves are aligned to provide a continuous groove 86 for receiving a container spring band 88 and a container gasket 90 therein.

The embodiment of container assembly 58 illustrated in FIG. 2 is for a stainless steel or other metal container assembly. If container assembly is made from plastic, container 60 and container collar assembly 72 can be formed integrally by injection molding techniques.

As discussed above with reference to door assembly 10, spring band 88 is positioned radially outwardly from gasket 90. Spring band 88 is configured to engage an outer peripheral surface 92 of gasket 90 and to apply a radially inwardly directed force on gasket 90 when spring band 88 is in its normal, relaxed position illustrated in FIG. 2. Spring band 88 has a shape identical to the shape of spring band 32 in FIG. 1. Movement of spring band 88 to its flexed position by plunger 94 is accomplished in a manner identical to the movement of spring band 32 to its flexed position by plunger 40 discussed above with reference to FIG. 3. Therefore, a detailed discussion of the structure and function of spring band 88 will not be provided.

Container assembly 58 also includes a lid 96 having a generally concave outer peripheral surface 98. An inner surface 100 of gasket 90 is configured to engage the outer surface 98 of lid 96 when spring band 88 is in its normal, relaxed position. This provides two separate functions for container assembly 58. The first function of a gasket 90 and spring band 88 is to provide a seal between collar assembly 72 and lid 96. This prevents contaminants from passing into the sterile interior region 66 of container 60. The second function of gasket 90 and spring band 88 is to retain lid 96 within collar assembly 72, thereby preventing removal of lid 96 from collar assembly 72.

Figure 4:
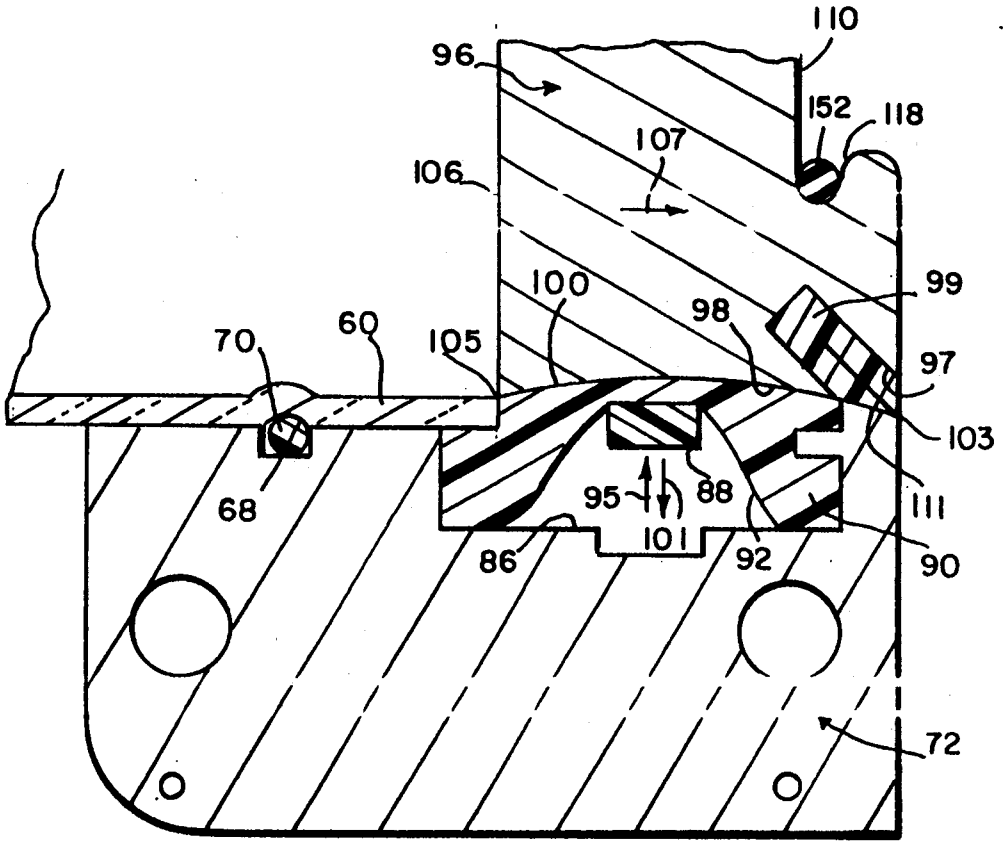
FIG. 4 is an enlarged partial sectional view taken through the container collar assembly and lid illustrating the spring band which forces the lid gasket radially inwardly against a generally concave outer peripheral surface of the lid to prevent removal of the lid from the container collar assembly.
Figure 5:
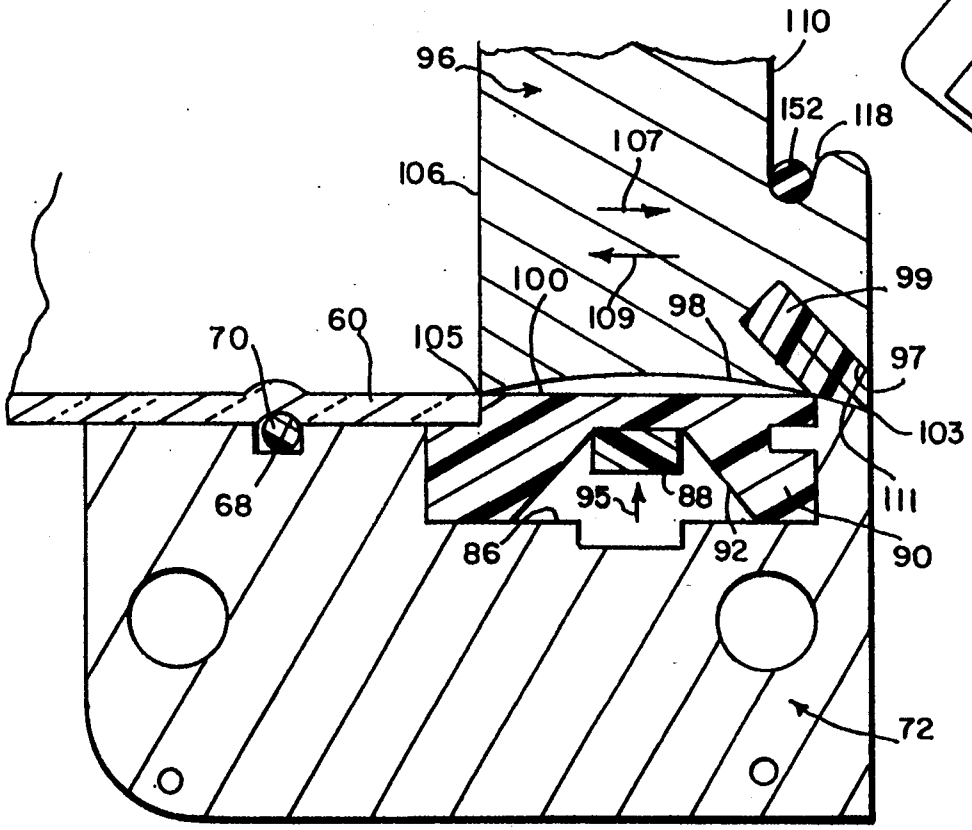
FIG. 5 is a sectional view similar to FIG. 4 in which the spring band has been moved to its flexed position to permit the lid gasket to move away from the outer peripheral surface of the lid to its non-biased memory position, thereby permitting removal of the lid from the container collar assembly.

FIGS. 4 and 5 illustrate operation of the gasket 90 and spring band 88. FIG. 4 illustrates spring band 88 in its normal relaxed position. Therefore, spring band 88 applies a radially inwardly directed force on gasket 90 in the direction of arrow 95 which, in turn, forces inner surface 100 of gasket 90 toward outer peripheral surface 98 of lid 96. Lid 96 includes an outer edge 103 and an inner edge 105. When gasket 90 and spring band 88 are in the position illustrated in FIG. 4, inner surface 100 of gasket 90 extends radially inwardly past inner edge 105 to block movement of lid 96 in the direction of arrow 107. Therefore, lid 96 is retained within the collar assembly 72. Lid 96 is formed to include an angled circumferentially extending groove 97. A gasket 99 is located in groove 97 to provide an additional seal for lid 96 against collar assembly 70 and door 52.

When plunger 94 is moved radially inwardly, spring band 88 moves in the direction of arrow 101 to remove the radially inwardly directed biasing force from gasket 90. Once spring band 88 moves away from gasket 90, gasket 90 assumes its predetermined memory shape illustrated in FIG. 5. Therefore, the inner edge 105 of lid 96 can move past inner surface 100 of gasket 90 to permit lid 96 to be removed from collar assembly 70 in the direction of arrow 107. Movement of lid 96 in the direction of arrow 109 further into the container 60 is still blocked. Outer edge 103 of lid 96 engages a tapered surface 111 of container collar assembly 72 thereby preventing movement of lid 96 in the direction of arrow 109. When it is desired to seal and retain lid 96 in collar assembly 72, plunger 92 is moved radially outwardly to permit spring band 88 to move to its normal, relaxed position in the direction of arrow 95. Therefore, spring band 88 applies a radially inwardly directed force on gasket 90 to move the inner surface 100 of gasket 90 to the position illustrated in FIG. 4 to seal and retain lid 96 in container collar assembly 72.

Door 52 is sealed and retained in door collar assembly in a manners identical to the manner lid 96 is sealed and retained in container collar assembly 72. Therefore, a detailed discussion of the procedure for sealing door 52 is not provided.

Operation of the transfer port apparatus of the present invention is illustrated in FIGS. 6–8. When it is desired to transfer an item 102 from an exterior region 16 to an interior region 14 of the isolation chamber, it is important that contaminants are not transmitted into interior region 14 with item 102. Therefore, item 102 is sterilized along with the inner surface 104 defining the inner region 66 of container 60. The inner surface 106 of lid 96 is also sterilized. However, an outer surface 108 of container 60 and an outer surface of 110 of lid 96 may contain contaminants. In addition, collar assembly 72 may contain contaminants. Therefore, the entire container assembly 58 cannot be transported into interior region 14 of the isolation chamber without introducing contaminants into interior region 14.

Item 102 is first sterilized and loaded into the sterile interior region of container 60. Lid 96 is then coupled to collar assembly to seal the inner region 66 of container 60. Container assembly 58 is then coupled to door assembly 10. As illustrated in FIG. 6, collar portion 22 of door assembly 10 is formed to include a hook 112 thereon. Connector block 78 of container collar assembly 72 is formed to include a slot 114 complementary to hook 112. As illustrated in FIG. 6, slot 114 is inserted over hook 112 and container is pivoted in the direction of arrow 120 toward door assembly 10.

Door 52 is formed to include a raised lip 116 configured to mate with a recessed lip 118 formed in lid 96, thereby locking lid 96 to door 52. In FIG. 6, springs 46 maintain plungers 40 and 94 in their outwardly-biased position to permit spring bands 32 and 88, respectively, to remain in their normal, relaxed position. In the normal, relaxed position, spring band 32 applies a radially inwardly directed force to gasket 34 to seal and retain door 56 in door collar assembly 20 and 22. In addition, spring band 88 applies a radially inwardly directed force against gasket 90 so that gasket 90 engages concave outer surface 98 of lid 96 to seal lid 96 and to retain lid 96 in collar assembly 72.

As illustrated in FIG. 7, raised lip 116 on door 56 enters recessed lip 118 of lid 96 to secure door 52 to lid 96. Any contaminants which might exist on surface 110 of lid 96 are trapped against surface 122 of door 52. Seal 99 illustrated in FIGS. 4 and 5 abuts the edge of door 52 to keep any contaminants trapped between door 52 and lid 96. A gasket 119 is provided on collar portion 22 to provide a seal between container collar assembly 72 and door collar portion 22. A tri-fold clamp latching mechanism 124 or other suitable fastener is then moved in the direction of arrow 126 to engage collar assembly 72. Latching mechanism 124 is moved to the latched position illustrated in FIG. 8 to secure the container assembly 58 to the door assembly 10. Latch mechanism 124 is located 180° opposite from hook 112.

Movement of latching mechanism 124 to lock container assembly 58 to door assembly 10 forces plungers 40 and 94 radially inwardly in the direction of arrow 126 in FIGS. 7 and 8. The direction of arrow 126 corresponds to the direction of arrow 50 in FIG. 3. Therefore, heads 42 of plungers 40 and 96 engage ramped surfaces 38 of spring bands 32 and 88, respectively. This moves spring bands 32 and 88 to their flexed positions and releases tension on gaskets 34 and 90, respectively. This permits the coupled door 52 and lid 96 to be removed as a unit in the direction of arrow 128 in FIG. 8 into interior region 14 of the isolation chamber. An operator can reach through wall 12 of the isolation chamber using conventional gloves (not shown) to grab handle 56 and remove the door and lid unit when the size of the door and lid unit permits such removal. If the size of the door and lid unit is:too large for manual removal, a mechanism (not shown) inside interior region 14 of the isolation chamber is controlled by the operator to remove the door and lid unit.

Once the door and lid unit is removed, item 102 in interior region 66 of container 60 can then be removed from container 60 without introducing contaminants into interior region 14. The surfaces of container assembly 58 and door assembly 10 which are exposed to interior region 14 of the isolation chamber are all sterile. After item 102 is removed, the coupled door 52 and lid 96 unit is inserted back into the door collar assembly 20 and 22 and container collar assembly 72. Door 52 has an inner edge 130 and an outer edge 132. The inner edge 130 engages tapered surface 134 on collar portion 20 to prevent movement of inner edge 130 of door 52 beyond inner surface 136 of door collar portion 120.

After the coupled door 52 and lid 96 are reinserted to the position illustrated in FIG. 7, latching mechanism 124 is released which permits springs 46 coupled to plungers 40 and 94 to move plungers 40 and 94 radially outwardly. Therefore, spring bands 32 and 88 return to their normal, relaxed position and apply radially inwardly directed forces to gaskets 34 and 90. This causes gaskets 34 and 90 to seal and to retain door 56 and lid 96, respectively. Container assembly 58 can then be moved away from the door assembly 10 in the direction of arrow 138 of FIG. 6.

As discussed above, a pressure source or a vacuum source may be coupled to ports 139 and 141 of container collar assembly 72 and door collar assembly 20 and 22, respectively. The pressure source or vacuum source can be used in place of spring bands 32 and 88 to move gaskets 34 and 90.

Figure 10:
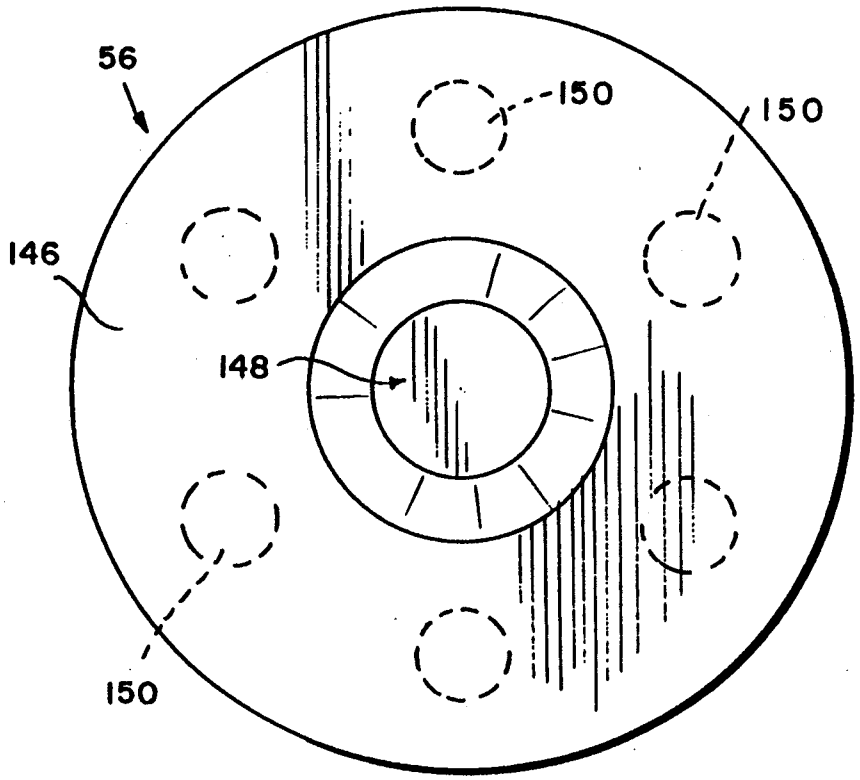
FIG. 10 is a side elevational view taken along lines 10—10 of FIG. 9 illustrating the configuration of the magnets below the surface of the door.
Figure 9:
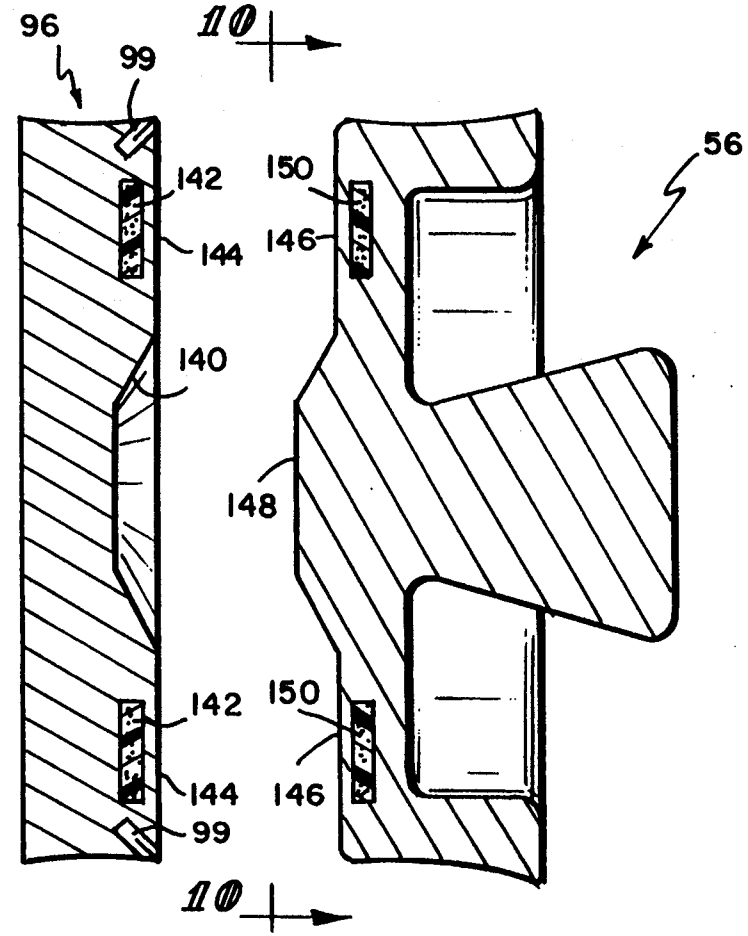
FIG. 9 is a sectional view of a second embodiment of the door and lid of the present invention in which magnets are used in the door and a ferromagnetic material is used in the lid to secure the door to the lid.

FIGS. 9 and 10 illustrate another embodiment of lid 96 and door 52 which may be used with the present invention. In this embodiment, lid 96 includes a truncated conical recessed section 140 and ferromagnetic material 142 positioned near surface 144 of lid 96. Surface 146 of door 56 is formed to include a truncated conical projection 148 configured to mate with recessed section 140 of lid 96. Lid 56 also includes magnets 150 located slightly below surface 146 of door 156. Magnets 150 and ferromagnetic material 142 are preferably located as close to the top Of surface 146 as possible. If door 56 and lid 96 are made from a plastic material, magnets 150 and ferromagnetic material 142 can be molded directly into the plastic. If door 56 and lid 96 are made from stainless steel, the magnets 150 and ferromagnetic material 142 are covered by thin sheet of stainless steel. Magnets 150 and ferromagnetic material 142 must be located as close as possible to surfaces 146 and 144, respectively, to maintain enough magnetic flux to retain door 56 to lid 96 when the door and lid unit is removed during the step illustrated in FIG. 8. The remaining structure of door 56 and lid 96 is identical to the structure discussed earlier.

FIG. 10 illustrates one embodiment of the arrangement of magnets 150 below surface 146 of door 56. It is understood, however, that other configurations of magnets 150 may be used to couple door 56 to lid 96. Ferromagnetic material 142 in lid 96 is arranged in the same pattern to be aligned with magnets 150 in door 56.

Another method for coupling door 56 to lid 96 is illustrated in FIGS. 4 and 5. In this embodiment, an O-ring seal 152 is inserted in recessed lip 118 of lid 96. This O-ring seal engages the lip projection 116 on door 56 to retain door 56 and lid 96 together as a unit. The O-ring seal 152 is particularly useful when the door 56 and lid 96 are made from stainless steel or other metal material. O-ring seal 152 is not required if lid 96 and door 52 are made of a plastic material which is soft enough to flex to permit lip 116 to mate with lip 118 yet stiff enough to hold lid 96 and door 52 together after the lips 116 and 118 are locked.

In the claims, the term "cover" is intended to refer to any type of closure for sealing a port or aperture. In other words, the term "cover" may be a door 52 for sealing port 18 in wall 12 or lid 96 for sealing open end 64 of container 60.

Although the illustrated embodiment discloses a generally round shaped lid and door, it is understood that the lid and door may have any desired shape such as a rectangular shape. The improved sealing and retaining means of the present invention advantageously permits the use of doors and lids having any configuration.

Although the invention has been described in detail with reference to a certain preferred embodiment, variations and modifications exist within the scope and spirit of the invention as described and defined in the following claims.

What is claimed is:

1. A transfer port apparatus for transferring an item through a port formed in a wall of a housing and into an interior region of the housing, the apparatus comprising:

a door collar assembly formed to include an aperture therethrough, an arcuate groove surrounding the aperture, and means for coupling the door collar assembly to the wall of the housing so that the aperture is in communication with the port to permit insertion of the item into the interior region of the housing;

a door gasket located in the arcuate groove of the door collar assembly;

a door configured to be inserted into the aperture of the door collar assembly, the door having an outer peripheral surface aligned with the door gasket; and means for biasing the door gasket against the outer peripheral surface of the door to retain the door in the door collar assembly and to seal the door in the door collar assembly.

2. The apparatus of claim 1, further comprising means for disengaging the door gasket biasing means so that the door gasket moves away from the outer peripheral surface of the door to permit the door to be removed from the door collar assembly.

3. The apparatus of claim 1, further comprising means for aligning the door with the door collar assembly so that the outer peripheral surface of the door is aligned longitudinally with the door gasket.

4. The apparatus of claim 1, further comprising:

a container having a closed end and a open end defining an interior region of the container for holding the item to be inserted into the interior region of the housing therein;

a container collar assembly coupled to the open end of the container, the container collar assembly being formed to include an aperture therein in communication with the open end of the container and an arcuate groove surrounding the aperture;

a lid gasket located in the arcuate groove of the container collar assembly;

a lid configured to be inserted into the aperture of the container collar assembly, the lid having an outer peripheral surface aligned with the lid gasket;

means for biasing the lid gasket against the outer peripheral surface of the lid to retain the lid in the container collar assembly and to seal the lid in the container collar assembly; and means for coupling the door collar assembly to the lid collar assembly so that the aperture of the door collar assembly is aligned with the aperture of the container collar assembly to permit the item to be transferred from the container to the interior region of the housing through the port in the wall.

5. The apparatus of claim 4, further comprising means for disengaging the door gasket biasing means and the lid gasket biasing means so that the door gasket moves away from the outer peripheral surface of the door to permit the door to be removed from the door collar assembly and so that the lid gasket moves away from the outer peripheral surface of the lid to permit the lid to be removed from the container collar assembly, thereby providing communication between the interior region of the housing and the interior region of the container.

6. The apparatus of claim 5, further comprising means for coupling the lid to the door so that the lid and door can be removed from the container collar assembly and lid collar assembly as a unit.

7. The apparatus of claim 6, wherein the means for coupling the lid to the door includes a lip portion formed on a surface of the door and means formed on the lid for receiving the lip portion of the door therein to secure the door to the lid.

8. The apparatus of claim 6, wherein the means for coupling the lid to the door includes means for magnetically coupling the door to the lid.

9. The apparatus of claim 4, further comprising means for aligning the door with the door collar assembly so that the outer peripheral surface of the door is aligned longitudinally with the door gasket and means for aligning the lid with the container collar assembly so that the outer peripheral surface of the lid is aligned longitudinally with the lid gasket.

10. The apparatus of claim 4, wherein the door gasket biasing means and the lid gasket biasing means each include a spring band for forcing the door gasket and the lid gasket radially inwardly toward the door and lid, respectively.

11. The apparatus of claim 4, wherein the door gasket biasing means and the lid gasket biasing means include a pressure source coupled to the door collar assembly and the container collar assembly, respectively.

12. The apparatus of claim 4, wherein the door gasket biasing means and the lid gasket biasing means include a vacuum source coupled to the door collar assembly and the container collar assembly, respectively.

13. An apparatus for closing and sealing a port defined by a wall, the apparatus comprising:

a collar assembly formed to include an aperture therethrough and means for coupling the collar assembly to the wall so that the aperture is in communication with the port, the collar assembly being formed to include an arcuate groove surrounding the aperture;

a cover configured to be inserted into the aperture of the collar assembly to close and seal the port, the cover having a generally concave outer peripheral surface;

a gasket located in the arcuate groove of the collar assembly; and a spring band configured to apply a biasing force against the gasket to hold the gasket against the outer peripheral surface of the cover so that the gasket blocks longitudinal movement of the cover relative to the collar assembly to retain the cover in the collar assembly and also to seal the cover in the collar assembly.

14. The apparatus of claim 13, further comprising means for disengaging the spring band so that the gasket moves away from the concave outer peripheral surface of the cover to permit the cover to be removed from the collar assembly.

15. The apparatus of claim 13, further comprising means for aligning the cover with the collar assembly so that the outer peripheral surface of the cover is aligned longitudinally with the gasket.

16. A transfer port apparatus for transferring an item through a port formed in a wall of a housing and into an interior region of the housing, the apparatus comprising:

a door collar assembly formed to include an aperture therethrough, an arcuate groove surrounding the aperture, and means for coupling the door collar assembly to the wall of the housing so that the aperture is in communication with the port to permit insertion of the item into the interior region of the isolation chamber;

a door gasket located in the arcuate groove of the door assembly;

a door configured to be inserted into the aperture of the door collar assembly, the door having an outer peripheral surface aligned with the door gasket; and means for biasing the door gasket against the outer peripheral surface of the door to retain the door in the door collar assembly and to seal the door in the door collar assembly;

a container having a closed end and a open end defining an interior region of the container for holding the item to be inserted into the interior region of the housing therein;

a container collar assembly coupled to the open end of the container, the container collar assembly being formed to include an aperture therein in communication with the open end of the container and an arcuate groove surrounding the aperture;

a lid gasket located in the arcuate groove of the container collar assembly;

a lid configured to be inserted into the aperture of the container collar assembly, the lid having an outer peripheral surface aligned with the lid gasket;

means for biasing the lid gasket against the outer peripheral surface of the lid to retain the lid in the container collar assembly and to seal the lid in the container collar assembly; and means for coupling the door collar assembly to the lid collar assembly so that the aperture of the door collar assembly is aligned with the aperture of the container collar assembly to permit the item to be transferred from the container to the interior region of the housing through the port in the wall.

17. The apparatus of claim 16, further comprising means for disengaging the door gasket biasing means and the lid gasket biasing means so that the door gasket moves away from the outer peripheral surface of the door to permit the door to be removed from the door collar assembly and so that the lid gasket moves away from the outer peripheral surface of the lid to permit the lid to be removed from the container collar assembly, thereby providing communication between the interior region of the housing and the interior region of the container.

18. The apparatus of claim 17, further comprising means for coupling the lid to the door so that the lid and door can be removed from the container collar assembly and lid collar assembly as a unit to provide access to the item in the interior region of the container from the interior region of the housing.

* * * * *